US008601661B2

(12) United States Patent
Riestra

(10) Patent No.: US 8,601,661 B2
(45) Date of Patent: Dec. 10, 2013

(54) MANUALLY-OPERATED HYDRAULIC FLANGE SPREADER AND ALIGNER

(75) Inventor: Antonio Cami Riestra, Lleida (ES)

(73) Assignees: Luis Gerardo Oyervides Ochoa, Nuevo Leon (MX); Antonio Cami Riestra, Lleida (ES)

( * ) Notice: Subject to any disclaimer, the term of this patent is extended or adjusted under 35 U.S.C. 154(b) by 422 days.

(21) Appl. No.: 12/950,448

(22) Filed: Nov. 19, 2010

(65) Prior Publication Data

US 2011/0203089 A1 Aug. 25, 2011

(30) Foreign Application Priority Data

Feb. 22, 2010 (MX) ..... MX/a/2010/002061

(51) Int. Cl.
*B25B 27/06* (2006.01)

(52) U.S. Cl.
USPC ..... 29/252; 29/278

(58) Field of Classification Search
USPC ..... 29/252, 244, 278, 281.1, 255
See application file for complete search history.

(56) References Cited

U.S. PATENT DOCUMENTS

| | | | | |
|---|---|---|---|---|
| 3,069,761 | A * | 12/1962 | Sommer | 29/252 |
| 6,266,861 | B1 * | 7/2001 | Chen | 29/261 |
| 6,609,283 | B1 * | 8/2003 | Somerville | 29/262 |
| 6,895,646 | B1 * | 5/2005 | Houg | 29/252 |
| 7,669,306 | B2 * | 3/2010 | Palka | 29/261 |
| 8,146,221 | B2 * | 4/2012 | Hung | 29/252 |
| 2010/0251528 | A1 * | 10/2010 | Hu | 29/252 |
| 2011/0203089 | A1 * | 8/2011 | Riestra | 29/252 |

FOREIGN PATENT DOCUMENTS

EP 1 325 794 A1 7/2003

* cited by examiner

*Primary Examiner* — Lee D Wilson
(74) *Attorney, Agent, or Firm* — Birch, Stewart, Kolasch & Birch, LLP

(57) ABSTRACT

An hydraulic tool for spreading and aligning flanges that may be used practically at any location where the flange is located, even at places where there is little maneuvering space and does not require a previous opening in order to attack the flange. The tool of the present invention doesn't require peripheral equipments such as hoses and pressure pumps; therefore it is an autonomous tool.

20 Claims, 5 Drawing Sheets

MANUALLY-OPERATED HYDRAULIC FLANGE SPREADER AND ALIGNER

TECHNICAL FIELD OF THE INVENTION

Flanges are commonly used in the industry, particularly in the gas and oil industry, which allow the connection of pipe runs or processing equipments.

There is a great variety of flanges, being the great sized flanges of particular importance. In the procedure commonly used to separate two flanges of these characteristics, either for preventive maintenance or for repairs, a minimum of two people is required, one of them for placing a chisel or a similar tool in the coupling of the flanges, and other individual for hitting said chisel with a mallet, whereby sufficient force is transmitted to execute the initial operation of flange separation, for example a minimum of 6 mm, in order to use afterwards one of the spreaders existing in the market.

This procedure, which is commonly used, involves a high risk both for the physical integrity of the workers, and for the facilities themselves.

In case of using more sophisticated tools, the issue becomes operational, because due to the complexity and great size of the tools, the access and maneuverability in the place where the flanges are installed become difficult.

On the other hand, once the maintenance or repair is done, it is necessary to couple again the flanges, for which it is necessary to align both flanges in such a way that allows the introduction of the screws in the holes of the flanges, and threading the corresponding nuts.

BACKGROUND OF THE INVENTION

Most of known hydraulic flange spreaders use a hydraulic pump with their respective hydraulic flow hoses and pressure gauges of the system, which causes the operation thereof at the workplace to be complex because of their size and design of the tools. An example of fluid operation in a tool is European patent application EP 1 325 794 A1, which describes a fluid operated torque wrench having a cylinder portion (2) with a cylinder (4) having an axis (A) and a driving portion (3), two pistons (5, 8) movable in the cylinder along the axis (A). Said tool also comprises two ratchet-lever mechanisms (15, 19) located in the driving portion (3), and a fluid supply (16, 17) into the cylinder, so that when the fluid is supplied at opposite sides of the pistons (15), either one ratchet-lever mechanism (15) turns and the other (19) ratchets, or vice versa. In order to operate the tool, fluid must be injected from an outer source, and, as mentioned in the description of the document, the fluid supply is done through the fluid system (16) and (17), for which the torque wrench requires outer fluid supply for its operation.

In contrast, the present invention refers to a sealed hydraulic tool which is manually driven.

BRIEF DESCRIPTION OF THE INVENTION

The flange spreader and aligner of the present invention is designed under the concept of having a minimum number of pieces, not requiring a mechanism or outer device, being ready to be operated in the most adverse conditions of heat, rain, sludge, dirt, strikes, and not requiring maintenance, so they don't require specialized technicians for their operation.

The flange spreader and aligning tool of the present invention may be used almost in any place where the flange is located, even in places where there is little maneuvering space. The use of the tool doesn't require a previous opening which allows attacking the flange; this is thanks to a wedge with perfect triangle attack.

Another essential aspect in the use of this tool is that the wedge is interchangeable, so wedges of 30°, 60°, rome or standard, or the wedge that the user deems more convenient for the specific operation.

The flange spreader and aligner tool of the present invention doesn't require peripheral equipment such as hoses and pressure pumps; therefore it is an autonomous tool.

The hydraulic tool for spreading and aligning flanges of the present invention comprises a casing-sleeve (1); a support (18) having a central threaded hole to threadedly house the casing-jacket (1); two mobile tension rods (3, 3') which are displaced along the support (18), each having a hole to be coupled to the bolt (4) which is introduced in the holes of two flanges (32, 33) that are attached; a threaded rod (19) being threadedly housed at one of its ends in a nut-sleeve (13) of the casing-sleeve (1), and being coupled to its other end to a torque casing (28); the torque casing (28) having four steel balls (23) housed in a stationary and equidistant manner, mounted in such a way that only half the diameter of each of the balls protrudes, and a selector (24) that houses a plurality of spring washers (21) concentric to their axis; at least two levers (26) attached to the torque casing (28), in a way that upon applying a manual rotating force on the levers (26) they transmit the torque to the spring washers (21) and to the selector (24), which, by the steel balls (23) rotate the threaded rod (19); the threaded rod (19) upon rotating inside the nut-sleeve (13) of the casing sleeve (1) urges a ball (9) that in turn transmits the force to a first piston (12), the threaded rod (19) which is attached to the first piston (12) through a notch, the ball (9) functions as drive and axial dummy bearing, the force exerted on the first piston (12) displaces hydraulic fluid from a first chamber (11), through galleries, to a second chamber (29) which advances a second piston (16); wherein the advancement of the second piston (16) advances the wedge (5) interchangeably attached to the end of the second piston (16), in a way that upon advancing the wedge (5) the same is introduced between the two inner faces of the flanges (32, 33) by separating them.

The hydraulic fluid may be any liquid appropriate for being used in tools or hydraulic devices, for example hydraulic oil.

In a further embodiment, the hydraulic tool for separating and aligning flanges also comprises a flange aligning device (31) placed between the wedge (5) and the flanges (32, 33), in a way that the advancement of the wedge (5) urges the aligning device (31) causing a central protrusion (36) of the flange aligning device to be inserted between the two sections of the flange (32, 33), while two arms (34, 35) of the flange aligning device make contact with the outer walls of the flanges (32, 33), the further advancement of the wedge (5) causes the flanges to be aligned.

BRIEF DESCRIPTION OF THE DRAWINGS

The present invention will become more obvious from the following description, including the best embodiment thereof, addressed to those skilled in the art, which makes reference to the accompanying drawings, wherein.

ELEMENTS OF THE LANGE SPREADER AND ALIGNER

Figure 1:
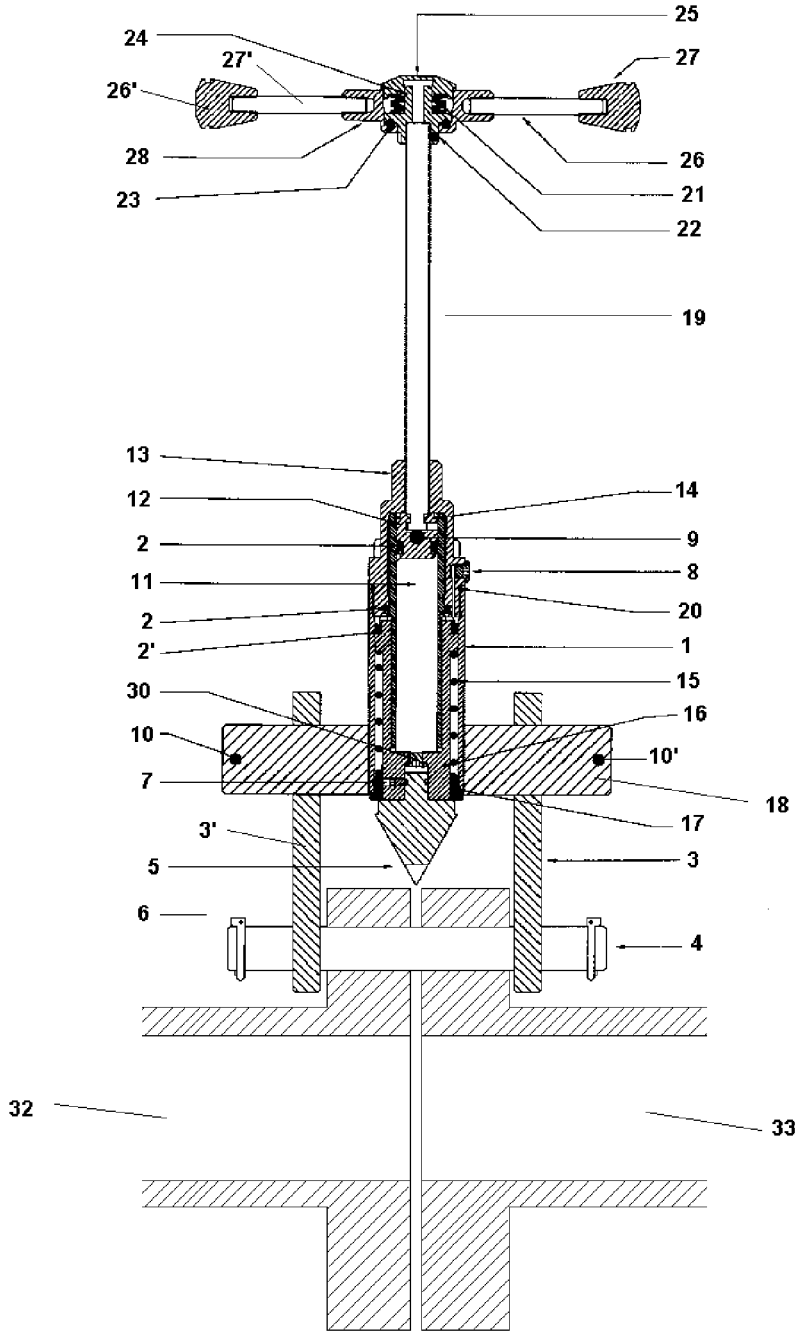
FIG. 1 is a cross-sectional view of the flange spreader and aligner tool, in its embodiment of flange spreader, mounted in a flange in its starting position.

1. Casing-sleeve
2. Piston detents
3. Tension rod
4. Bolt
5. Wedge
6. Bolt latch
7. Wedge coupling screw
8. Hydraulic fluid cap
9. Ball
10. Latch screw
11. Hydraulic fluid chamber
12. First piston
13. Sleeve nut
14. Piston latch
15. Spring
16. Second piston
17. Spring stop nut
18. Support
19. Threaded rod
20. O-ring
21. Spring washers
22. Rod coupling screw
23. Torque balls
24. Selector
25. Selector cap
26. Driving lever
27. Ratchet cone
28. Torque casing
29. Hydraulic fluid chamber
30. Piston cap
31. Flange aligning device
32. Left section of flange
33. Right section of flange
34-35. Arms of the flange aligning device
36. Central protrusion of the flange aligning device
37. Slot of the flange aligning device

DETAILED DESCRIPTION OF THE INVENTION

The present invention acknowledges and takes into account the considerations and methods of the prior art.

Figure 2:
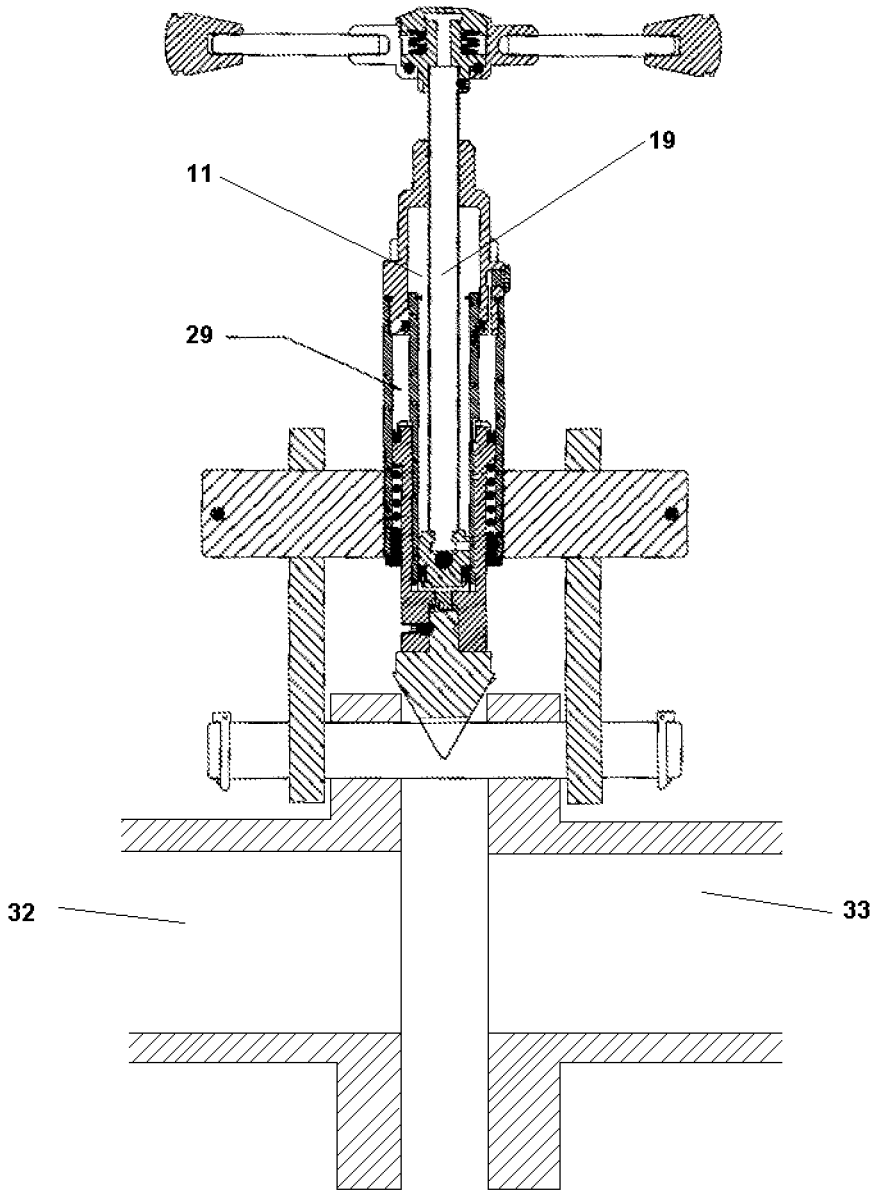
FIG. 2 is a cross-sectional view of the flange spreader and aligner tool, in its embodiment of flange spreader, mounted in a flange in its final position.

As illustrated in FIGS. 1 and 2, in the embodiment of flange spreader, the flange spreader and aligning tool comprises a bolt (4), which is inserted in one of the holes of the flanges, the bolt (4) is coupled to two mobile tension rods (3, 3'), through a hole in each of the tension rods, which are displaced along the support (18), in order to be able to vary the distance between the mobile tension rods (3, 3'), depending on the thickness of the flanges to be separated. The support (18) has two threaded screws (10, 10') that perform the function of safety stop of the tension rods (3, 3'), so that they don't come out of the support (18).

The support (18) has a central threaded hole (not shown) in order to house the casing-sleeve (1). Said hole also has the function of threading or unthreading the casing-sleeve (1), and thus to advance or causing the wedge (5) to go forward or backward with respect to the bolt (4). The wedge (5) is interchangeable and is coupled to the second piston (16) through set screw (7).

Two levers (26, 26') are manually driven by an operator, and have two cones (27, 27') at their ends for a better manual operation.

Figure 3:
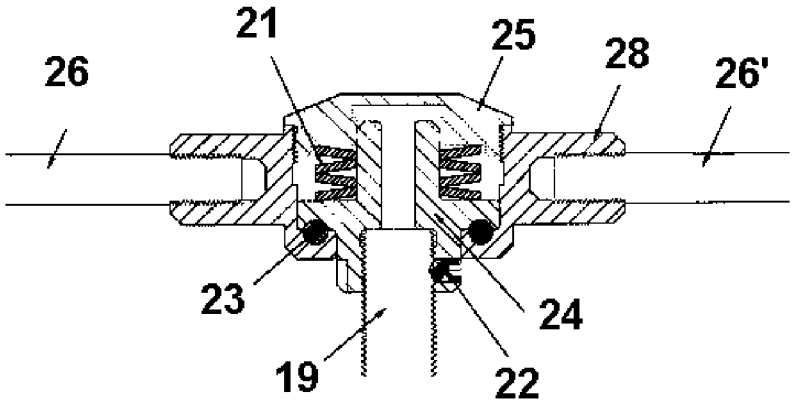
FIG. 3 is a cross-sectional view of the torque casing and the driving levers.

As illustrated in FIG. 3, the two levers (26, 26') are attached to a torque casing (28) which houses four steel balls (23) which are fixedly and equidistantly mounted in such a way that only half of the diameter of each of the balls protrudes. A selector (24) houses a plurality of spring washers (21) concentric to its axis. The spring washers or disk springs, also known as Belleville spring, are placed in series or in parallel and perform the same function as a spring. If the spring washers are used, more force shall be necessary in order to be able to bend them, it's like using a thicker spring. In the present invention, spring washers are used due to the fact that they use little space, in order to perform the same function as a spring, which should at least have a diameter twice as big, thus it is excessively large to be housed in the torque receiving casing. The spring washers (21) perform the function of establishing the maximum torque that the operator may apply to the driving levers (26) manually.

In reference to FIG. 3 again, a first portion of the lever and torque casing assembly is made up of threaded rod (19) and the selector (24). They are both attached by the screw (22) thus forming one single rotation body. A second portion of said assembly is constituted by the levers (27) the torque casing (28), the balls (23), the cap (25), and the spring washers (21), forming all these pieces one single rotation body.

The first portion is attached to the second portion by the steel balls (23), both portions may rotate simultaneously if the spring washers (21) are not bent, or otherwise the second portion may rotate, remaining the first portion fixed, if the washers are bent causing the steel balls (23) to jump from a semispherical notch to the following. A little over half the diameter of each steel ball (23) is screwed (permanently fixed) to the casing (28), the other half of the diameter of each steel ball (23) remains inserted in the semispherical gaps located in the selector (24).

The spring washers (21) exert a force (depending on the number of washers) on the selector (24), on the balls (23) that are fixed to the casing (28).

The spring washers (21) exert a driving force that forces the first portion to be attached to the second portion (through the pressure of the washers). The cap (25) determines if the spring washers are more or less bent. The more the cap (25) tightens the washers (21), more force will be generated against the selector (24), and this in turn against the balls (23) housed permanently in the casing (28).

If more bending is generated in the washers, more torque will be needed to be applied to the levers (27) in order to rotate the rod (19), in such a way that in order to jump from one semispherical notch to the next the balls (23) shall compress more the washers.

The piston diameter (19) and the maximum work pressure are the variables that define the maximum torque that may be applied. or example, if a force of 10 tons is desired to be generated in the wedge (5), once the variables are defined, the number of spring washers (21) necessary to be able to rotate the levers manually (27) is inserted, until the exact moment when an external manometer gauge, connected in the hydraulic fluid filler cap (8) indicates that the maximum work pressure has been reached (for example 360 Bar) whereby a force of 10 tons will be developing.

If the torque exerted on the levers (27) is done by one person, so that there is no fatigue and develops the 10 tons, the interrelation of the variables are correct.

In case the torque applied is higher to that set by the spring washers (21), the selector (24) is slided by jumping above the steel balls (23), without transmitting the rotating force to the threaded rod (19). If this doesn't happen, the threaded rod (19) pushes de ball (9) which in turn transmits the force to the first piston (12). The threaded rod (19) is attached to the first piston (12) by a dovetail notch. The ball (9) performs the function of thrust and of axial dummy bearing. The threaded rod (19) is housed in the nut-sleeve (13), and may be threaded or unthreaded in its interior.

The torque casing (28) is closed by a cap (25) that leaves the spring washers (21) isolated from the outside. The torque casing (28) is attached to the threaded rod (19) by a set screw (22). The threaded rod (19) is housed in the nut-sleeve (13), whereby the threading or unthreading of the rod is done (19).

The invention comprises a piston latch (14) that secures the rod (19) with the first piston (12), so that if the spring (15) can't make the backward movement of the second piston (16), the threaded rod (19), returns to its starting position. The piston latch (14) is a steel ring that prevents the threaded rod (19) from protruding from the dovetail notch which is in the first piston (12), and that secures its position upon the unthreading of the rod, that is, once the piston stroke is finished and the starting point wants to be reached again, the spring (15) pushes the second piston upwards, and the rod (19) drags the piston (12) due to the fact that it is inserted in the dovetail notch. The spring (15) helps the backward movement of the piston, and the dovetail notch in case the spring can't make the backward movement, for any reason, thrusts the piston to move backward indefectibly.

The piston is a simple effect piston, so if for any reason the spring (15) cannot displace the hydraulic fluid from the largest diameter chamber to the smallest diameter chamber, and there is no attachment by the security ring between the first piston (12) and the threaded rod (19), upon unthreading the rod, the piston will not return, remaining the rod extended without having moved backward to its starting position, whereby the piston latch is a safety and precautionary element.

The nut-sleeve (13) has a threaded hole closed by the cap (8) and a threaded hole (30) in the second piston (16), both holes having the function of filling and purging of the hydraulic fluid.

The spring stop nut (17) closes the casing-sleeve (1) by the front portion of the second piston (16), while performing the function of mounting base of the spring (15).

The equipment is sealed by the O-ring (20), sealing the coupling between the nut-sleeve (13) and the casing-sleeve (1), and the outer and inner detents (2, 2') which seal the casing-sleeve (1) from the outside.

Before operating the flange spreader and aligner tool, in its flange spreader mode, the bolt is introduced (4) in the holes of the flanges, and in the hole of one of the two tension rods (3, 3'), which are placed one at each side of the flanges.

Once the flange spreader is mounted, a rotation force is manually applied on the levers (26), which, when attached to the torque casing (28) transmit the torque to the spring washers (21) and to the selector (24), that by the steel balls (23) will rotate the threaded rod (19).

While threading the rod (19) the first piston (12) displaces the hydraulic fluid from the first chamber (11), through galleries, into the second chamber (29) (FIG. 2) which advances the second piston (16). The first chamber (11) has a smaller diameter than the diameter of the second chamber (29), so the stroke of the first piston (12) is greater than the stroke of the second piston (16). In the preferred embodiment, the diameter of the first chamber (11) is about half the diameter of the second chamber (29), therefore the stroke of the first piston (12) is about twice the stroke of the second piston (16).

The forward movement of the second piston (16) advances the interchangeable wedge (5) in such a way that the wedge (5) is introduced between the two inner faces of the flanges by separating them. The wedge (5) is attached to the second piston (16) through the set screw (7).

Figure 4:
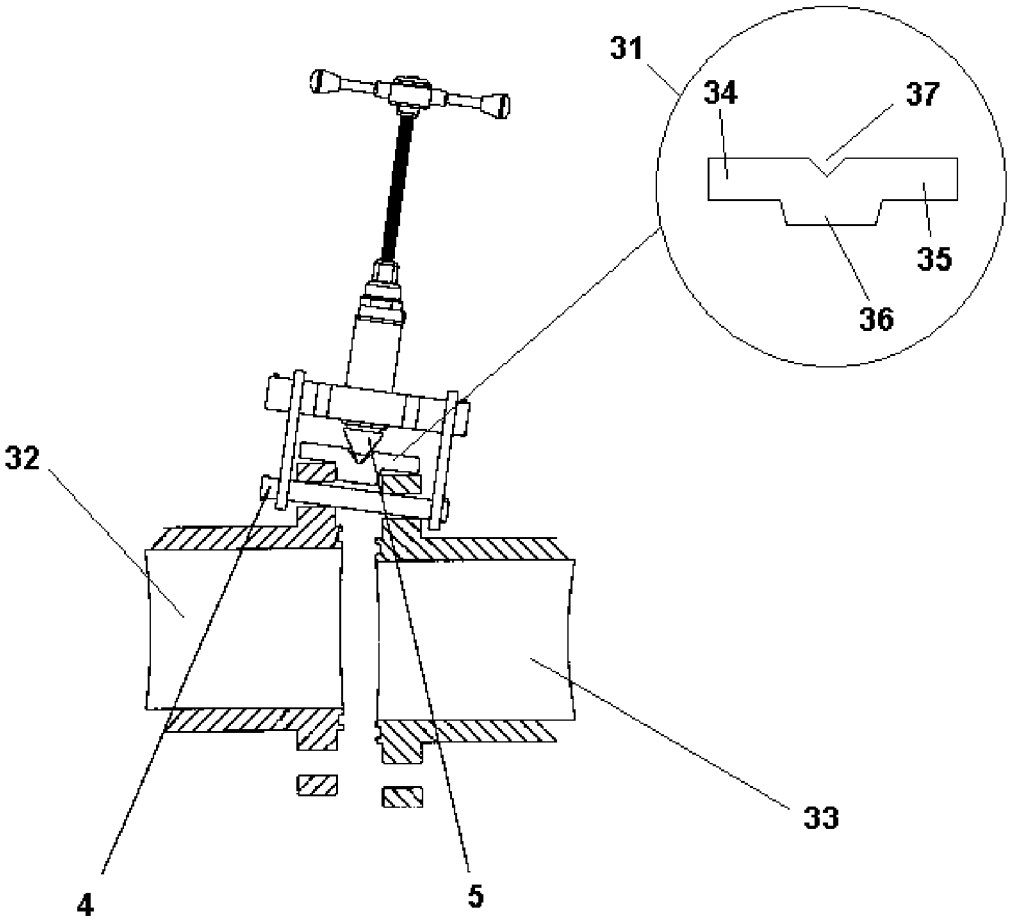
FIG. 4 shows the flange spreader and aligning tool, in its embodiment of flange aligner, before aligning the flanges.

When the stroke of the first piston ends (12) this abuts against the inner sleeve of the second piston (16), becoming blocked. At this point, the reverse operation may be performed, that is, to unthread the threaded rod (19) by the manual application of a reverse torque over the driving levers (26). It must be done in this way, until the first piston (12) abuts against the nut-sleeve (13). At this point, the hydraulic fluid of the second chamber (29) will have passed completely to the first chamber (11). In reference to the function of flange aligner of the bride spreader and aligner tool, as illustrated in FIGS. 3 and 4, a flange aligning device (31) is placed between the wedge (5) and the flanges (32, 33). The flange aligning device has a slot (37) at angle with straight walls, whose angle is greater than that of the wedge (5). The flange aligning device (31) has two supporting arms, one supporting arm (34) for the right segment of the flange (33), and a support arm (35) for the left segment of the flange (32), equidistant to the center of the slot, and a central protrusion (36) which protrudes from the arms in order to penetrate between the two flanges.

For the use of the flange spreading and aligning tool in its flange aligning mode, first the bolt is positioned (4) in one of the holes of the flanges, positioning the flange spreader as described above in the function of flange spreader. The flange aligning device (31) is placed between the two flanges, and the wedge (5) is placed in the vicinity of the slot (37) of the aligning device (31).

The angle formed between the working drawing and an imaginary straight line from the outmost border of the left section flange hole (32) to the outmost border of the right section flange hole (33) limits the diameter of the bolt (4) to be used.

The lower diameter bolt (4) must be used if there is a greater angle of deviation between the left section flange hole (32) and the right section flange (33).

Figure 5:
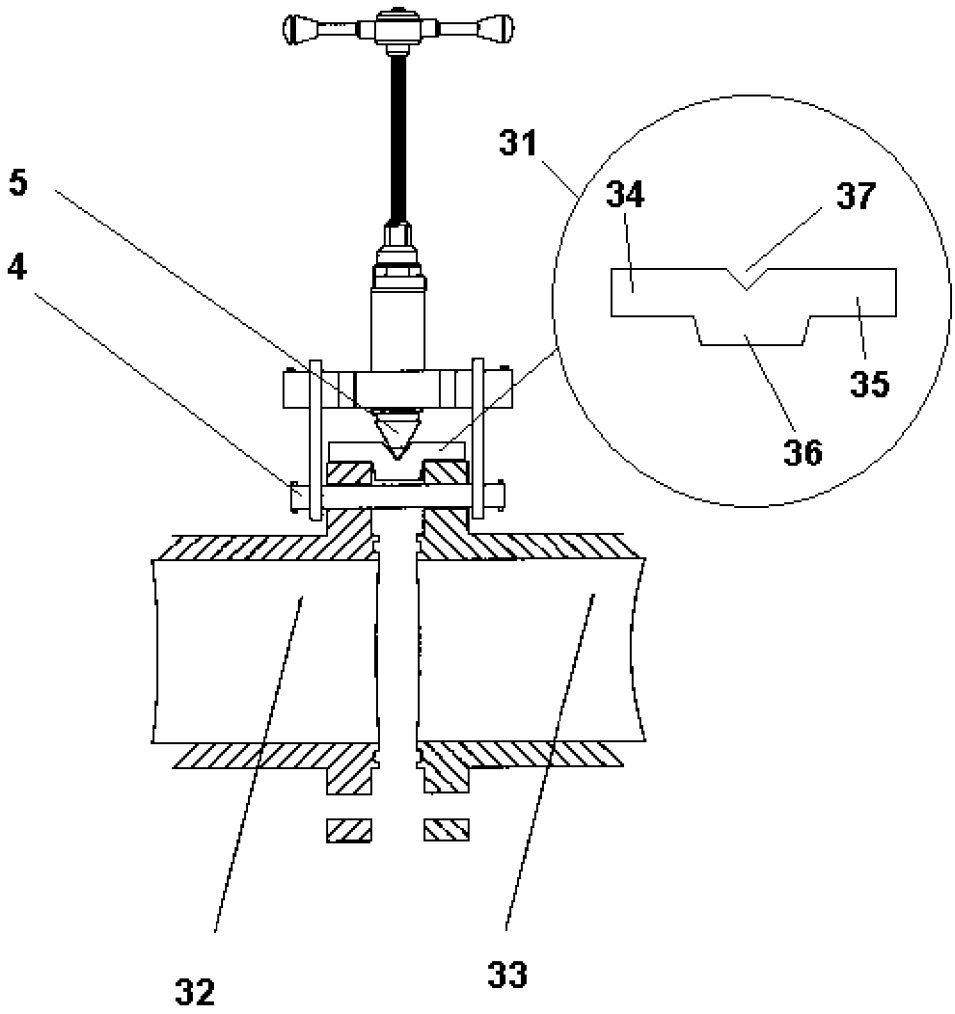
FIG. 5 shows the flange spreader and aligning tool, in its embodiment of flange aligner, once the flanges have been aligned.

The flange spreader and aligner, in its embodiment of flange aligner, is actuated in the manner described above for the embodiment of flange spreader, whereby the interchangeable wedge (5) advances into the aligning device (31) getting inserted in the slot 37, as shown in FIG. 4. The forward movement of the wedge (5) pushes the aligning device (31) causing the central protrusion (36) of the flange aligning device to be inserted between the two flange sections (32, 33), while the arms (34, 35) of the flange aligning device make contact with the outer walls of the flanges (32, 33). The further forward movement of the wedge (5) causes the flanges to be aligned, as shown in FIG. 5.

Therefore, those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An hydraulic tool for spreading and aligning flanges comprising:

a casing-sleeve (1);

a support (18) having a central threaded hole for threadedly housing the casing-sleeve (1);

two tension rods (3, 3') displaced along the support (18), and having each a hole to be coupled to a bolt (4) which is inserted in the holes of two flanges (32, 33) that are attached;

a threaded rod (19) that one end is threadedly housed in a nut-sleeve (13) of the casing-sleeve (1), and another end is coupled to a torque casing (28);

the torque casing (28) having housed therein four balls (23) fixedly and equidistantly mounted in such a way that only half of the diameter of each of the balls protrudes and a selector (24) having housed therein a plurality of spring washers (21) concentrical to an axis of the selector;

at least two levers (26) attached to the torque casing (28), so that when applying a rotation force manually on the levers (26), they transmit the torque to the spring washers (21) and to the selector (24), which, through the balls (23) rotates the threaded rod (19);

the threaded rod (19) upon rotating within the nut-sleeve (13) of the casing-sleeve (1) pushes a ball (9) which in turn transmits the force to a first piston (12), the threaded rod (19) is attached to the first piston (12) by a notch, the ball (9) performs the function of thrust and axial dummy bearing, the force applied to the first piston (12) which displaces hydraulic fluid from a first chamber (11), through the galleries, into a second chamber (29) that advances a second piston (16);

wherein the forward movement of the second piston (16) advances a wedge (5) interchangeably attached to the end of the second piston (16), so that upon advancing the wedge (5) the wedge is introduced between the two inner faces of the flanges (32, 33) by separating the flanges.

2. An hydraulic tool for spreading and aligning flanges comprising:

a casing-sleeve (1);

a support (18) having a central threaded hole for threadedly housing the casing-sleeve (1);

two tension rods (3, 3') displaced along the support (18), having each a hole to be coupled to a bolt (4) which is introduced in the holes of two flanges (32, 33) that are attached;

a threaded rod (19) that one end is threadedly housed in a nut-sleeve (13) of the casing-sleeve (1), and another end is coupled to a torque casing (28);

the torque casing (28) having housed therein four balls (23) fixedly and equidistantly mounted in such a way that only half of the diameter of each of the balls protrudes and a selector (24) having housed therein a plurality of spring washers (21) concentrical to an axis of the selector;

at least two levers (26) attached to the torque casing (28), so that when applying a rotation force manually on the levers (26), they transmit the torque to the spring washers (21) and to the selector (24), which, through the balls (23) rotates the threaded rod (19);

the threaded rod (19) upon rotating within the nut-sleeve (13) of the casing-sleeve (1) pushes a ball (9) which in turn transmits the force a first piston (12), the threaded rod (19) is attached to the first piston (12) by a notch, the ball (9) performs the function of thrust and axial dummy bearing, the force applied to the first piston (12) which displaces hydraulic fluid of a first chamber (11), through the galleries, to a second chamber (29) that advances a second piston (16);

wherein the forward movement of the second piston (16) advances a wedge (5) interchangeably attached to the end of the second piston (16);

a flange aligning device (31) placed between the wedge (5) and the flanges (32, 33), in a way that the advancement of the wedge (5) urges the aligning device (31) causing that a central protrusion (36) of the flange aligning device is inserted between the two sections of the flange (32, 33), while two arms (34, 35) of the flange aligning device make contact with the outer walls of the flanges (32, 33), the further advancement of the wedge (5) causes the flanges to be aligned.

3. The hydraulic tool for spreading and aligning flanges according to claim 1, wherein the plurality of spring washers (21) perform the function of setting the maximum torque that may be manually applied to the driving levers (26).

4. The hydraulic tool for spreading and aligning flanges according to claim 3, wherein the plurality of spring washers (21) are located in series or in parallel.

5. The hydraulic tool for spreading and aligning flanges according to claim 3, wherein the plurality of spring washers (21) is a Belleville washer.

6. The hydraulic tool for spreading and aligning flanges according to claim 1, wherein the threaded rod (19) is attached to the first piston (12) through a dovetail notch.

7. The hydraulic tool for spreading and aligning flanges according to claim 1, wherein the first chamber (11) has a smaller diameter than the second chamber (29), thus the stroke of the first piston (12) is greater than the stroke of the second piston (16).

8. The hydraulic tool for spreading and aligning flanges according to claim 7, wherein the diameter of the first chamber (11) is about half the diameter of the second chamber (29), thus the stroke of the first piston (12) is about twice the stroke of the second piston (16).

9. The hydraulic tool for spreading and aligning flanges according to claim 1, wherein the wedge (5) is attached to the second piston (16) through the set screw (7).

10. The hydraulic tool for spreading and aligning flanges according to claim 1, wherein an O-ring (20), seals the coupling between the nut-sleeve (13) and the casing-sleeve (1), and some outer and inner detents (2, 2') seal the casing-sleeve (1) from the outside.

11. The hydraulic tool for spreading and aligning flanges according to claim 1, wherein the torque casing (28) is attached to the threaded rod (19) through a set screw (22).

12. The hydraulic tool for spreading and aligning flanges according to claim 1, wherein the torque casing (28) is closed by a cap (25) that leaves the spring washers (21) isolated from the outside.

13. The hydraulic tool for spreading and aligning flanges according to claim 12, wherein the cap (25) further determines if the spring washers are more or less bent, the more the cap (25) tightens the washers (21), the more the force generated against the selector (24) will be, and this against the balls (23) permanently housed in the casing (28).

14. The hydraulic tool for spreading and aligning flanges according to claim 1, wherein upon the end of the stroke of the first piston (12), the first piston abuts against the inner sleeve of the second piston (16), becoming blocked, at which point the reverse operation may be performed, that is to unthread the threaded rod (19) through the manual application of a reverse torque on the driving levers (26), until the first piston (12) abuts against the nut-sleeve (13), in a way that the hydraulic fluid of the second chamber (29) passes completely to the first chamber (11).

15. The hydraulic tool for spreading and aligning flanges according to claim 1, wherein the balls (23) are made of steel.

16. The hydraulic tool for spreading and aligning flanges according to claim 1, wherein the hydraulic fluid is hydraulic oil.

17. The hydraulic tool for spreading and aligning flanges according to claim 2, wherein the flange aligning device (31) has a slot (37) in angle with straight walls where the wedge is inserted (5), whose angle is greater than that of the wedge (5), two support arms, one support arm (34) for the right segment of the flange (33), and one support arm (35) for the left segment of the flange (32), equidistant to the center of the slot, and a central protrusion (36) that protrudes from the arms for penetrating between the two balls, in a way that the forward movement of the wedge (5) thrusts the aligning device (31) causing the central protrusion (36) of the flange aligning device is inserted between the two sections of the flange (32, 33), while the arms (34, 35) of the flange aligning device make contact with the outer walls of the flanges (32, 33), the further forward movement of the wedge (5) causes the flanges to remain aligned.

18. The hydraulic tool for spreading and aligning flanges according to claim 17, wherein the angle formed, between the working drawing and an imaginary straight line from the outmost border of the left section flange hole (32) to the outmost border of the right section flange hole (33), limits the diameter of the bolt (4) to be used.

19. The hydraulic tool for spreading and aligning flanges according to claim 18, wherein a bolt (4) of smaller diameter must be used if there is an angle of greater shift between the left section flange holes (32) and the right section flange (33).

20. The hydraulic tool for spreading and aligning flanges according to claim 2, wherein the plurality of spring washers (21) perform the function of setting the maximum torque that may be manually applied to the driving levers (26).

* * * * *